US005976322A

United States Patent [19]

Marzolini

[11] Patent Number: 5,976,322

[45] **Date of Patent: *Nov. 2, 1999**

[54] PROCESS FOR PRODUCING PAPER AND PAPERBOARD HAVING HIGH MECHANICAL STRENGTH

[75] Inventor: Fausto Marzolini, Milan, Italy

[73] Assignee: Ausimont SpA, Milan, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/798,717

[22] Filed: Feb. 12, 1997

Related U.S. Application Data

[63] Continuation of application No. 08/525,042, Sep. 8, 1995, abandoned.

[30] Foreign Application Priority Data

Sep. 8, 1994 [IT] Italy ..... MI94A1838 U

[51] Int. Cl.[6] ..... D21H 17/74

[52] U.S. Cl. ..... 162/175; 162/181.2; 162/181.3; 162/181.4; 162/181.5; 162/183

[58] Field of Search ..... 162/175, 181.2–18.5, 162/183

[56] References Cited

U.S. PATENT DOCUMENTS

| | | | |
|---|---|---|---|
| 1,834,903 | 12/1931 | Rafton | 162/175 |
| 2,036,882 | 4/1936 | Pattilloch et al. | 162/175 |
| 2,207,555 | 7/1940 | Rowland | 162/175 |
| 3,128,223 | 4/1964 | von Rosenberg et al. | 162/181.3 |
| 3,264,174 | 8/1966 | Aitken et al. | 162/175 |
| 3,640,842 | 2/1972 | Hullinger et al. | 162/175 |
| 4,487,657 | 12/1984 | Gomez | 162/175 |
| 4,582,627 | 4/1986 | Carlsson | 162/181.5 |
| 4,818,341 | 4/1989 | Degen et al. | 162/168.2 |
| 5,082,528 | 1/1992 | Hartman | 162/175 |
| 5,167,849 | 12/1992 | Seeholzer et al. | 162/181.2 |
| 5,512,135 | 4/1996 | Carré et al. | 162/181.5 |

FOREIGN PATENT DOCUMENTS

| | | | |
|---|---|---|---|
| 759363 | 5/1967 | Canada | 162/181.5 |
| 0 285 487 | 10/1988 | European Pat. Off. . | |
| 285486 | 10/1988 | European Pat. Off. | 162/175 |
| 29 24 947 | 1/1981 | Germany . | |
| 509002 | 7/1939 | United Kingdom | 162/175 |
| 1 282 551 | 7/1972 | United Kingdom . | |
| 1371600 | 10/1974 | United Kingdom | 162/175 |

OTHER PUBLICATIONS

Three–page European Search Report.

English abstract of European Patent Application No. 0 285 487.

English abstract of German Patent Application No. 29 24 947.

Casey, Pulpand Paper, 3rd ed (1981) vol III Wilen–Interscience, pp. 1476–1479.

*Primary Examiner*—Peter Chin

*Attorney, Agent, or Firm*—Burns, Doane, Swecker & Mathis, L.L.P.

[57] ABSTRACT

Process for producing paper and paperboard, which comprises adding to a cellulose pulp stock a natural starch and an aluminum and/or iron salt. The so obtained cellulose pulp stock is then submitted to dewatering and subsequent calendering according to conventional techniques. In such a way, retention of the natural starch on the cellulose fibers is remarkably increased. To further increase retention it is particularly advantageous to pre-mix the natural starch with the aluminum and/or iron salt and then to add the resulting mixture to the cellulose pulp stock.

9 Claims, No Drawings

PROCESS FOR PRODUCING PAPER AND PAPERBOARD HAVING HIGH MECHANICAL STRENGTH

This application is a continuation of application Ser. No. 08/525,042, filed Sep. 8, 1995 now abandoned.

The present invention relates to a process for producing paper and paperboard having high mechanical strength.

It is known that, during production of paper and paperboard, addition of starches to cellulose pulp stock improves mechanical properties of the finished product (in particular dry and bursting strength). Therefore, the addition of starches results particularly advantageous when partially degraded cellulose, such as that deriving from recycled paper products, is used as raw material. As known, natural starch per se shows scarce affinity to cellulose fibers and to fillers contained in the pulp. Hence, a poor retention results and thus an increase of starch concentration in plant circuits, besides a certain worsening of dewatering, a bad working of recovery devices and an increase of Chemical Oxygen Demand (COD) and of Biological Oxygen Demand (BOD) of the effluents after a prolonged use.

For these reasons paper producers are orienting to the use of modified starch, in particular cationic starch. The latter is prepared by reacting natural starch in an alkaline medium with a suitable cation-producing agent, for instance amines or ammonium salts, such as (diethyl-2-chloroethyl) ammonium chloride or (epoxypropyltrimethyl)ammonium chloride. The use of cationic starch generally yields good results, but it implies a remarkable increase of production costs.

In U.S. Pat. No. 4,818,341 a process is described for producing paper and paperboard, wherein, as reinforcing and binding agent, a mixture is used consisting of potato natural starch and a particular cationic polymer comprising units of (a) diallyldimethylammonium chloride; (b) N-vinylamine; or (c) a N-vinylimidazoline. Also in this case the use of particular cationic polymers makes the process economically disadvantageous, especially for production on a large scale and/or when starting from cellulosic raw materials of poor quality (for instance recycled paper).

The Applicant has now surprisingly found that retention of natural starch on cellulose fibers can be remarkably increased if an iron and/or aluminum salt is added to the cellulose pulp stock. Moreover, it has been found that the retention results considerably higher if the natural starch is previously mixed with the aluminum and/or iron salt and then the resulting mixture is added to the cellulose pulp stock.

Therefore, object of the present invention is a process for producing paper and paperboard, which comprises adding a natural starch and an aluminum and/or iron salt to a cellulose pulp stock. The so obtained cellulose pulp stock is then submitted to dewatering and subsequent calendering according to conventional techniques.

With natural starch it is meant the starch directly obtained from a natural source, such as grain, maize, rice, potato, and the like. In a preferred embodiment, the natural starch is previously submitted to a pre-gelatinization treatment, namely heating a starch aqueous suspension to a temperature higher than the gelatinization temperature of the starch itself, so as to make the latter water-soluble (with formation of the so called starch water). With gelatinization temperature it is meant the temperature at which the birefringence of the starch grains disappears (see already cited U.S. Pat. No. 4,818,341). It varies according to the type of starch and is generally comprised between 70° and 190° C., preferably between 90° and 130° C.

The aluminum and/or iron salts can be in particular selected from:

(i) aluminum polychloride, having formula:

$Al_a(OH)_bCl_c(SO_4)_d$, wherein: a, b, c, d are integers greater than zero; c is equal to 3a-b-2d; b/3a is generally from 0.2 to 0.8, preferably from 0.3 to 0.65; d/a is from 0.005 to 0.5, preferably from 0.01 to 0.1; or formula:

$Al_e(OH)_f\ Cl_g$, wherein: e, f, g are integers greater than zero; g is equal to 3e-f; f/3e is generally from 0.2 to 0.8, preferably from 0.3 to 0.65.

(ii) aluminum sulfate $Al_2(SO_4)_3$;

(iii) ferric chloride $FeCl_3$;

(iv) ferric chlorosulfate $FeClSO_4$.

Aluminum Polychloride is Particularly Preferred.

As already mentioned hereinbefore, in a preferred embodiment the natural starch and the aluminum and/or iron salt are used in admixture, for instance according to the following procedure:

(a) preparing an aqueous solution of natural starch by heating, according to known techniques, thus obtaining the so called starch water (pre-gelatinization process, see above);

(b) dissolving the aluminum and/or iron salt into the starch water;

(c) feeding the so obtained mixture into the cellulose pulp stock used for producing paper.

The concentration of the starch water prepared in step (a) is generally from 0.5 to 10% by weight, preferably from 1 to 5% by weight. Step (b) wherein the salt is dissolved in the starch water is generally carried out at a temperature of from 15° to 160° C., preferably from 30° to 95° C., for a time usually from 0.1 to 60 min, preferably from 1 to 20 min.

The aluminum and/or iron salt, expressed as $Me_2O_3$ (Me=Al, Fe) oxide, is added to the starch in amounts generally from 5 to 90, preferably from 10 to 60, parts by weight per 100 parts of starch. For aluminum polychlorides the amount is preferably from 10 to 40 parts by weight.

The natural starch is added to the cellulose pulp stock generally in an amount of from 0.1 to 10% by weight, preferably from 0.3 to 6% by weight, more preferably from 0.5 to 3% by weight, with respect to the dry cellulose.

The process object of the present invention can be employed for producing any kind of paper or paperboard, starting from a wide variety of cellulose fibers, for instance from sulfite or sulfate pulp, submitted to bleaching or as such, from thermomechanical pulp (TMP) or chemothermomechanical pulp (CTMP), or also from recycled cellulose fibers, optionally submitted to a deinking process, or from mixtures of virgin fibers and recycled fibers, etc.

Some working examples of this invention are reported hereinbelow, whose purpose is merely illustrative but not limitative of the scope of the invention itself.

EXAMPLE 1

Preparation of the Cellulose Fiber Pulp Stock.

320.5 g of bleached conifer sulfite cellulose and 320.5 g of bleached hardwood sulfate cellulose were pulped with a laboratory pulper into 12 l of water for 30 min obtaining a pulp stock with 5% by weight of dry matter. 13 l of water were added to such pulp stock, so that a pulp stock with 2.5% by weight of dry matter was obtained. Such pulp stock was then beated in a laboratory Valley hollander until a freeness of 30° SR, measured by a Shopper Riegler apparatus, was obtained. After beating, 4 kg of pulp stock were added, under stirring, to 16 l of water, to obtain a pulp stock with 0.5% by weight of dry matter, to be used in the subsequent process steps.

Preparation of the Starch.

47.5 g of natural maize starch were added, at room temperature and under stirring, to 952.5 g of water. Always under stirring, the starch suspension was gradually brought to a temperature of 92°–96° C. and kept at such temperature for 20–30 minutes until complete gelatinization of the starch. The weight was then brought again to 1000 g by adding additional water. The so obtained starch water had a concentration of 4.75% by weight.

Preparation of the Starch/PAC Mixture.

To 84.0 g of the above-prepared starch water, kept at 70° C., 2.47 g of B-type aluminum polychloride (PAC) (PAC-B, see Table 2) was additioned. Water was then added up to a total weight of 100 g. Upon stirring for 1 min, a mixture containing 2.476% by weight of PAC-B and 4.0% by weight of starch, calculated on the dry matter, was obtained.

Addition of the Starch/PAC Mixture to the Cellulose Pulp Stock.

To 1 kg of the 0.5% cellulose pulp stock prepared as described above, stirred by means of a Jar Test apparatus working at 200 rpm, 7.5 g of the above-prepared starch/PAC mixture were added, so as to have a starch amount, calculated on the dry matter, of 6.0% by weights and a PAC-B amount of 3.7% by weight, the percentages being calculated with respect to the amount of dry cellulose in the pulp stock. After stirring for 3 minutes, starch retention degree on cellulose fibers was evaluated by COD measurements according to the following method.

400 g of the pulp stock were taken and introduced into a Shopper Riegler apparatus. After 5 seconds the inverted cone cap was lifted and the draining water collected through the non-gauged side hole, while the gauged central hole was previously closed and filled with water. COD was determined on 25 ml of the so drained water, by oxidation with potassium bichromate in acid medium and titration with ferrous sulfate, according to the method described by N. W. Hanson in "Official, Standardized and Recommended Methods of Analysis" (page 383, The Society for Analytical Chemistry, 1973). Of course, the lower the measured COD value, the greater the starch retention on the cellulose fibers. The results are reported in Table 1, wherein also the ΔCOD % value is indicated, namely the percent difference of the drained water COD with respect to the test where natural starch was used without PAC (Example 5). The COD value of the starch water at the working concentration (300 ppm) was 304 mg/l , while the starting COD of the cellulose pulp stock was 74 mg/l.

EXAMPLE 2

Example 1 was repeated in the same conditions, except that, instead of adding the previously prepared starch/PAC mixture, the two separate components were added to the cellulose pulp stock, in such amounts to obtain the same % by weight with respect to the dry cellulose: to 995.6 g of pulp stock initially 6.3 g of a 4.75% by weight starch water were added, then after 3 min of stirring 0.185 g of PAC-B; finally the mixture, formed by water, cellulose, starch and PAC-B was stirred for further 3 minutes in a Jar Test apparatus. The measured COD values are reported in Table 1.

EXAMPLES 3-4

Examples 1 and 2 were repeated in the same conditions but using a double amount of PAC-B (7.4% by weight on the dry cellulose). The results are reported in Table 1.

EXAMPLE 5 (comparative)

Example 1 was repeated in the same conditions, but using the starch alone without adding PAC. The results are reported in Table 1.

TABLE 1

| EX. | STARCH (% weight) | PAC-B (%) | PRE-MIX STARCH/PAC | COD (mg/l) | Δ COD (%) |
|---|---|---|---|---|---|
| 1 | 6 | 3.7 | yes | 118 | 36 |
| 2 | 6 | 3.7 | no | 133 | 28 |
| 3 | 6 | 7.4 | yes | 104 | 44 |
| 4 | 6 | 7.4 | no | 118 | 36 |
| 5* | 6 | — | — | 185 | — |

*comparative

EXAMPLE 6–15

Examples 3 and 4 were repeated in the same conditions using different salts as reported in Table 2: PAC-A (Ex. 6-7), PAC-C (Ex. 8-9), aluminum sulfate (AS) (Ex. 10-11), ferric chloride (FC) (Ex. 12-13) and ferric chlorosulfate (FCS) (Ex. 14-15). The amount of added salt, expressed as % by weight of oxide $Me_2O_3$ (Me=Al, Fe) with respect to the weight of dry cellulose, is 1.33% in all of rhe examples, equal to that of Examples 3-4. The used amounts and the COD values measured on the drained water are reported in Table 3.

TABLE 2

| Product | Empirical formula | Molar ratio OH/3Al | Composition (% weight) | |
|---|---|---|---|---|
| PAC-A | $Al_a(OH)_bCl_c(SO_4)_d$ | 0.58 | $Al_2O_3$ | 10 |
| | | | Cl | 6.5 |
| | | | $SO_4$ | 3 |
| PAC-B | $Al_a(OH)_bCl_c(SO_4)_d$ | 0.36 | $Al_2O_3$ | 18 |
| | | | Cl | 23 |
| | | | $SO_4$ | 1.4 |
| PAC-C | $Al_a(OH)_bCl_c$ | 0.47 | $Al_2O_3$ | 18 |
| | | | Cl | 20 |
| | | | $SO_4$ | 0 |
| Aluminum Sulfate (AS) | $Al_2(SO_4)_3$ | 0 | $Al_2O_3$ | 8 |
| | | | Cl | 0 |
| | | | $SO_4$ | 22.6 |
| Ferric Chloride (FC) | $FeCl_3$ | — | $Fe_2O_3$ | 20 |
| | | | Cl | 26.5 |
| Ferric chloro-sulfate (FCS) | $Fe_aCl_b(SO_4)_c$ | — | $Fe_2O_3$ | 18 |
| | | | Cl | 8 |
| | | | $SO_4$ | 21.6 |

TABLE 3

| | STARCH | SALT | | STARCH/ SALT | COD | Δ COD |
|---|---|---|---|---|---|---|
| EX. | (% weight) | type | % weiqht (°) | PRE-MIX | (mg/l) | (%) |
| 6 | 6 | PAC-A | 13.3 | yes | 102 | 45 |
| 7 | 6 | " | " | no | 110 | 40 |
| 8 | 6 | PAC-C | 7.4 | yes | 106 | 43 |
| 9 | 6 | " | " | no | 120 | 35 |
| 10 | 6 | AS | 16.6 | yes | 140 | 24 |
| 11 | 6 | " | " | no | 155 | 16 |
| 12 | 6 | FC | 6.5 | yes | 130 | 30 |
| 13 | 6 | " | " | no | 143 | 23 |
| 14 | 6 | FCS | 7.4 | yes | 136 | 26 |
| 15 | 6 | " | " | no | 150 | 19 |

(°) % by weiqht with respect to dry cellulose; in all of the examples it corresponds to 1.33% by weiqht of oxide $Me_2O_3$ with respect to dry cellulose.

EXAMPLES 16–18

Example 3 was repeated varying the amount of starch present in the starch/PAC-B mixture (4.0% by weight in Example 3). The results are reported in Table 4.

EXAMPLES 19–22

Example 18 was repeated varying the temperature at which the preparation of the starch/PAC-B mixture was carried out (70° C. in Example 18). The results are reported in Table 4.

EXAMPLES 23–27

Example 18 was repeated varying the stirring time for the preparation of the starch/PAC-B mixture (1 min in Example 18). The results are reported in Table 4.

TABLE 4

| | STARCH | PAC-B | STARCH/PAC-B PRE-MIX | | | | Δ |
|---|---|---|---|---|---|---|---|
| EX. | (% weight) | (% weight) | starch (% weight) | temp. (° C.) | time (min) | COD (mg/l) | COD (%) |
| 5* | 6 | 7.4 | — | — | — | 195 | — |
| 3 | 6 | 7.4 | 4.O | 70 | 1 | 104 | 44 |
| 16 | 6 | 7.4 | 3.O | 70 | 1 | 96 | 48 |
| 17 | 6 | 7.4 | 2.0 | 70 | 1 | 96 | 48 |
| 18 | 6 | 7.4 | 1.0 | 70 | 1 | 89 | 52 |
| 19 | 6 | 7.4 | 1.0 | 60 | 1 | 89 | 52 |
| 20 | 6 | 7.4 | 1.0 | 50 | 1 | 89 | 52 |
| 21 | 6 | 7.4 | 1.0 | 40 | 1 | 85 | 54 |
| 22 | 6 | 7.4 | 1.0 | 30 | 1 | 86 | 54 |
| 23 | 6 | 7.4 | 1.0 | 70 | 5 | 104 | 44 |
| 24 | 6 | 7.4 | 1.0 | 70 | 10 | 104 | 44 |
| 25 | 6 | 7.4 | 1.0 | 70 | 20 | 104 | 44 |
| 26 | 6 | 7.4 | 1.0 | 70 | 30 | 118 | 36 |
| 27 | 6 | 7.4 | 1.O | 70 | 60 | 126 | 32 |

*comparative

EXAMPLES 28–45

Example 1 was repeated varying the PAC-B concentration in the pre-mix with starch, so as to change the amount of PAC-B with respect to the cellulose in the final pulp stock, expressed both as PAC-B as such and as $Al_2O_3$. The same dosage ratios $Al_2O_3$/starch were maintained by varying the amount of starch with respect to the dry cellulose. The results are reported in Table 5.

TABLE 5

| | STARCH/PAC-B PRE-MIX | | | PAC-B | | | |
|---|---|---|---|---|---|---|---|
| EX. | PAC-B (g) | weight ratio $Al_2O_3$/starch | STARCH (% weight) | % weight | % weight $Al_2O_3$ | COD (mg/l) | Δ COD (%) |
| 5* | — | — | 6 | — | — | 185 | — |
| 28 | 1.23 | 0.05 | 6 | 1.7 | 0.30 | 140 | 24 |
| 1 | 2.47 | 0.1 | 6 | 3.7 | 0.66 | 118 | 36 |
| 29 | 4.94 | 0.22 | 6 | 7.4 | 1.33 | 104 | 44 |
| 30 | 7.41 | 0.32 | 6 | 10.8 | 1.95 | 148 | 20 |
| 31 | 9.88 | 0.44 | 6 | 14.8 | 2.66 | 155 | 36 |
| 32 | 12.35 | 0.89 | 6 | 29.6 | 5.32 | 172 | 7 |
| 33* | — | — | 3 | — | — | 165 | — |
| 34 | 1.23 | 0.05 | 3 | 0.85 | 0.15 | 140 | 15 |
| 35 | 247 | 0.1 | 3 | 1.7 | 0.30 | 116 | 29 |
| 36 | 4.94 | 0.22 | 3 | 3.7 | 0.66 | 94 | 43 |
| 37 | 7.41 | 0.32 | 3 | 5.4 | 0.97 | 108 | 35 |
| 38 | 9.88 | 0.44 | 3 | 7.4 | 1.33 | 116 | 30 |
| 39 | 12.35 | 0.89 | 3 | 14.8 | 2.66 | 137 | 17 |
| 40* | — | — | 1 | — | — | 144 | — |
| 41 | 1.23 | 0.05 | 1 | 0.28 | 0.05 | 132 | 8 |
| 42 | 2.47 | 0.1 | 1 | 0.61 | 0.1 | 95 | 35 |
| 43 | 4.94 | 0.22 | 1 | 1.23 | 0.22 | 78 | 46 |
| 44 | 7.41 | 0.32 | 1 | 1.80 | 0.32 | 97 | 33 |
| 45 | 9.88 | 0.44 | 1 | 2.46 | 0.44 | 118 | 18 |

*comparative

EXAMPLES 46–48

Examples 3–5 were repeated using, instead of virgin cellulose, recycled paper (50% of newspaper, 50% magazine paper), pulped in a pulper so as to obtain a pulp stock with 5.0% by weight of dry matter, subsequently diluted with water to obtain 0.5% by weight of dry matter. The results are reported in Table 6.

TABLE 6

| EX. | STARCH (% weight) | PAC-B (%) | STARCH/PAC PRE-MIX | COD (mg/l) | Δ COD (%) |
|---|---|---|---|---|---|
| 46 | 6 | 7.4 | yes | 200 | 40 |
| 47 | 6 | 7.4 | no | 225 | 32 |
| 48* | 6 | — | — | 333 | — |

*comparative

EXAMPLES 49–51

Examples 3–5 were repeated using, instead of natural maize starch, natural potato starch. The results are reported in Table 7.

TABLE 7

| EX. | STARCH (% weight) | PAC-B (%) | STARCH/PAC PRE-MIX | COD (mg/l) | Δ COD (%) |
|---|---|---|---|---|---|
| 49 | 6 | 7.4 | yes | 101 | 47 |
| 50 | 6 | 7.4 | no | 113 | 41 |
| 51* | 6 | — | — | 193 | — |

*comparative

EXAMPLE 52

The present invention was applied on an industrial plant for producing brown paper, with a production rate of about 500 m/min, using waste paper as raw material.

Natural maize starch was mixed with water in a weight ratio starch/water of 3/97, and subjected to pre-gelatinization by heating to a temperature of about 125° C. in a conventional industrial cooker. The obtained starch water was diluted to obtain a starch content of 1% by weight, and then PAC-B was dissolved therein by stirring in a polyethylene tank for 15 min at about 70° C., with a weight ratio starch water/PAC-B of 98.5/1.5.

The previous steps were carried out continuously to add the resulting starch/PAC-B mixture to the cellulose pulp stock (1% by weight of dry cellulose), which is continuously fed to the paper production plant. The addition of the starch/PAC-B mixture in the plant line was carried out after the feeding pump ("fun-pump") and before the "selecty fibre" apparatus. The weight ratio between the pulp stock and the starch/PAC-B mixture was 99/1, so as to obtain a starch amount of about 1.0% by weight, and a PAC-B amount of about 1.5% by weight, calculated on the dry cellulose. The plant run was carried out for 10 hours. At various times during the run, retention of the starch was evaluated by measuring the COD values of the circulating water, while the mechanical properties of the produced brown paper were determined by means of CMT (Concora Medium Test), according to TAPPI T 809 om/82.

The results are reported in Table 8, along with the values typical for a brown paper production run on the same plant, using, instead of the natural starch/PAC-B mixture, a cationic starch alone (commercial product HI-CATO 165), in an amount of 1.0% with respect to the dry cellulose. Upon comparing the data, it is apparent that the results obtained according to the present invention are, in terms of retention and mechanical properties of the produced paper, substantially equivalent to those obtainable when using a cationic starch.

TABLE 8

| EXAMPLE | TIME (hrs) | COD (mg/l) | CMT (N/cm) |
|---|---|---|---|
| 1.0% NATURAL STARCH + 1.5% PAC-B | 1 | 1210 | 170 |
| | 3 | 1180 | 174 |
| | 5 | 1190 | 173 |
| | 7 | 1220 | 170 |
| | 10 | 1210 | 172 |
| 1.0% CATIONIC STARCH | 10 | 1200 | 170 |

I claim:

1. Process for producing paper and paperboard starting from a cellulose pulp stock, comprising the steps of:

(a) preparing a water-soluble natural starch solution by heating a starch aqueous suspension to a temperature higher than the gelatinization temperature of the starch itself, thus obtaining starch water;

(b) dissolving into the starch water at a temperature of from 15° to 160° C., for a time of from 1 to 20 minutes, an aluminum polychloride having formula:

$Al_a(OH)_bCl_c(SO_4)_d$, wherein: a, b, c, d are integers greater than zero; c is equal to 3a-b-2d; b/3a is from 0.2 to 0.8; d/a is from 0.005 to 0.5; or formula;

$Al_e(OH)_fCl_g$, wherein: e, f, g are integers greater than zero; g is equal to 3e-f; f/3e is from 0.2 to 0.8;

(c) feeding the so obtained mixture into the cellulose pulp stock used for producing paper.

2. Process according to claim 1, wherein the natural starch is a starch directly obtained from grain, maize, rice, or potato.

3. Process according to claim 1, wherein the concentration of the starch water prepared in step (a) is from 0.5 to 10% by weight.

4. Process according to claim 1, wherein the aluminum polychloride, expressed as $Al_2O_3$ oxide, is added to the starch in an amount of from 5 to 90 parts by weight per 100 parts of starch.

5. Process according to claim 1, wherein in step (b) aluminum polychloride (i) is used in an amount, expressed as $Al_2O_3$ oxide, of from 10 to 40 parts by weight per 100 parts by weight of starch.

6. Process according to claim 1, wherein the natural starch is added to the cellulose pulp stock in an amount of from 0.1 to 10% by weight, with respect to the dry cellulose.

7. Process according to claim 6, wherein the natural starch is added to the cellulose pulp stock in an amount of from 0.3 to 6% by weight, with respect to the dry cellulose.

8. Process according to claim 7, wherein the natural starch is added to the cellulose pulp stock in an amount of from 0.5 to 3% by weight, with respect to the dry cellulose.

9. Process according to claim 1, wherein the cellulose pulp stock is selected from the group consisting of sulfite cellulose pulp, sulfate cellulose pulp, thermomechanical cellulose pulp (TMP), chemothermomechanical cellulose pulp (CTMP), recycled cellulose fibers optionally submitted to a deinking process, and a mixture of virgin fibers and recycled fibers.

* * * * *